United States Patent [19]

Miller et al.

[11] 4,043,457

[45] Aug. 23, 1977

[54] SAFETY MINE CAR COUPLING AND UNCOUPLING APPARATUS

[76] Inventors: Joseph Miller, General Delivery, Amherstdale, W. Va. 25607; Clinton Cline, General Delivery, Chapmanville, W. Va. 25508

[21] Appl. No.: 625,112

[22] Filed: Oct. 23, 1975

[51] Int. Cl.[2] ..... B61G 1/00

[52] U.S. Cl. ..... 213/75 B; 213/164; 213/218

[58] Field of Search ..... 213/159, 75 B, 161, 213/163, 164, 211, 213, 218, 98, 86, 198, 188; 105/364; 280/515

[56] References Cited

U.S. PATENT DOCUMENTS

| | | | |
|---|---|---|---|
| 146,918 | 1/1874 | Lamb | 213/213 |
| 265,065 | 9/1882 | Hazleton | 213/213 |
| 311,012 | 1/1885 | King | 213/218 |
| 2,470,531 | 5/1949 | Suhl et al. | 280.515 |

*Primary Examiner*—Robert B. Reeves
*Assistant Examiner*—H. Grant Skaggs
*Attorney, Agent, or Firm*—Burns, Doane, Swecker & Mathis

[57] ABSTRACT

A safety mine car coupling and uncoupling apparatus, adapted for attachment to the hitch of a conventional mine car to insert and withdraw a coupling pin, comprises a base plate attached to a member for guiding the travel of the coupling pin and one or more lever arms pivotably mounted on the base plate and extending beyond the plane of at least one lateral side of the car to permit an operator to couple and uncouple the car without standing between cars.

6 Claims, 5 Drawing Figures

SAFETY MINE CAR COUPLING AND UNCOUPLING APPARATUS

BACKGROUND OF THE INVENTION

In recent years, sophisticated machinery has evolved to couple and uncouple railroad cars equipped with horizontal clamp couplers and meet stringent safety standards. See, for example, U.S. Pat. No. 3,682,325 to Peterson. In contrast, coupling methods and apparatus for mine cars have remained virtually unchanged for substantial period of time.

Conventional mine cars employ a simple coupling comprising apertured hitches attached to either end of the cars adapted for connection to one another by the manual insertion of a coupling pin. The manual insertion or withdrawal of the coupling pin requires that an operator stand between cars at peril to life and limb.

Installation of conventional remote coupling and uncoupling devices on mine cires is impractical since such devices are adapted for use with the more sophisticated horizontal clamp couplers used on railroad rolling stock. In addition, modification of existing mine cars with conventional railroad coupling pin actuating devices such as those disclosed in U.S. Pat. Nos. 146,918; 156,440; and 311,012 would be impractical. Installation of these devices would require that the mine cars be taken out of service for extended periods of time to align the coupling mechanism with the car and hitch to insure a true vertical insertion of the pin through the apertures in the hitches. Installation would be further hampered by variations in the configurations of the car hitches and of the car walls abutting the hitch to which the actuation means of the conventional devices must be attached.

ADVANTAGES OF THE INVENTION

Accordingly, a primary object of the present invention is to provide a safety coupling and uncoupling apparatus for mine car, permitting remote insertion withdrawal of the coupling pin by an operator standing beyond the planes of the lateral side of the car.

A further object of the present invention is to provide a safety coupling and uncoupling apparatus for mine cars which may be installed on a mine car by a simple and expedient attachment of the apparatus to the hitch of the car.

Another object of the present invention is to provide a safety coupling and uncoupling apparatus comprising a self-contained, pre-alligned subassembly which may be installed merely by attachment to the hitch of a mine car and which requires only that the apparatus be alligned with the aperture in the hitch of the car to which the apparatus is attached.

Yet another object of the present invention is to provide a lever arm actuated apparatus permitting remote coupling and uncoupling of mine cars wherein integral pin and lever arm guides and pivotable supports for the lever arm are pre-assembled and affixed to a unitary base plate adapted for subsequent attachment to the hitch of a conventional mine car.

DETAILED DESCRIPTION

In accordance with the present invention, a safety coupling apparatus is provided, which apparatus is adapted for attachment to the hitch of a conventional mine car to insert and withdraw a coupling pin to couple and uncouple the car with an adjacent car.

Figure 1:
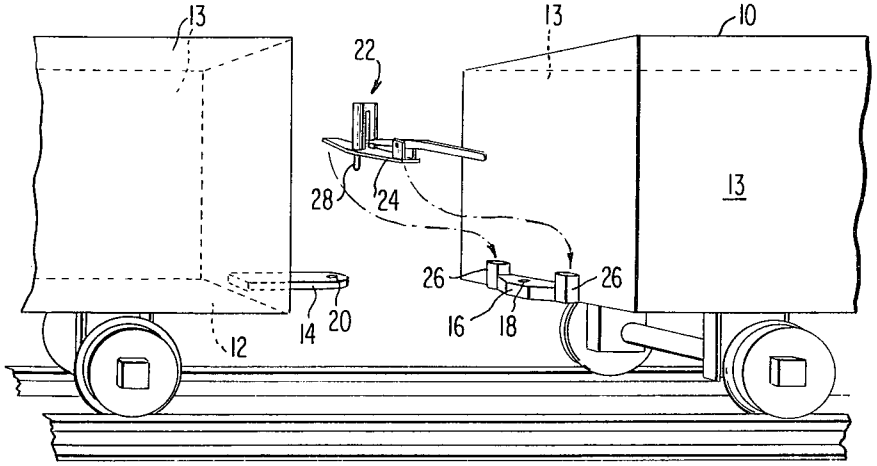
FIG. 1 is a perspective view of adjacent mine cars and hitches known in the art and an embodiment of the coupling apparatus of the present invention showing the installation of said embodiment on one of the cars.

Referring first to FIG. 1, two conventional mine cars 10 and 12 are depicted adjacent one another with their lateral sides 13 parallel to one another. A linkage between the cars may be established by positioning hitch 14 of car 12 adjacent hitch 16 of car 10 so that apertures 18 and 20 are in substantial alignment. A coupling pin may be inserted into the apertures 18 and 20 to couple the cars.

An embodiment of the present safety coupling apparatus is denoted generally by the numeral 22. The apparatus 22 may be permanently attached to the car 10 by welding, bolting or otherwise affixing a base plate 24 of the apparatus 22, to hitch members 26 so that a pin 28 is poised for insertion into aperture 18.

Figure 2:
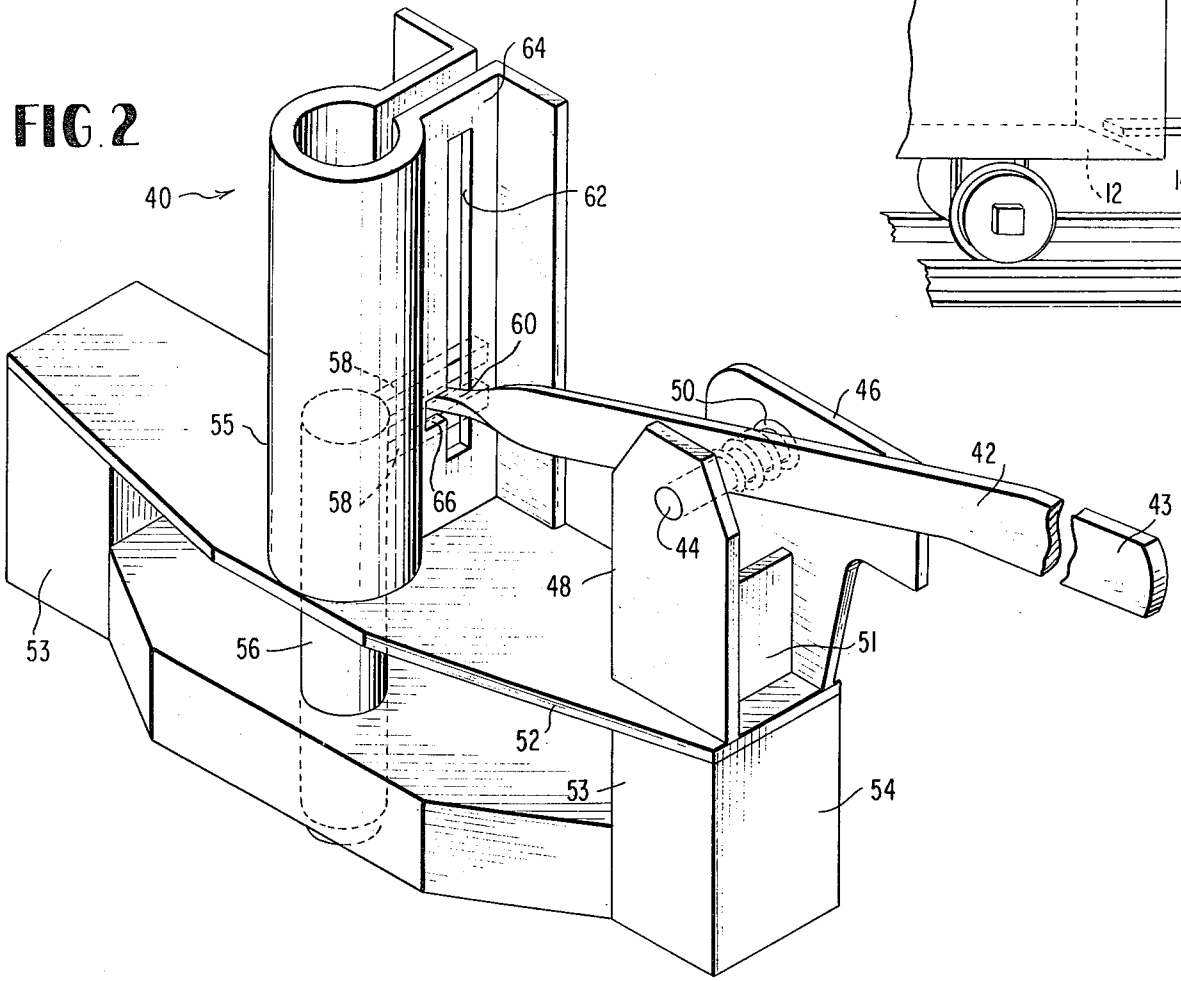
FIG. 2 is a perspective view of an embodiment of the coupling apparatus of the present invention.

With reference to FIG. 2, an embodiment of the present invention is denoted generally by the numeral 40. A lever arm 42, a proximal portion 43 of which is grasped by an operator, may be pivotably supported by shaft 44 attached to vertical parallel members 46 and 48. A spring means 50 may contact the parallel member 46 and may urge the lever arm 42 toward the parallel member 48.

The parallel members may be held in position by cross-member 51 and may be attached to horizontal base plate 52. The base plate 52 is adapted to be affixed to conventional mine car hitch 54. The base plate could be affixed to the hitch configuration in the figure by welding or bolting the base plate to vertical members 53 of the hitch. A channel means 55, attached to the base plate 52, may guide the insertion and withdrawal of coupling pin 56 into and out of hitch 54 and the hitch of an adjacent car (not shown). Actuation arms 58 may be attached to the coupling pin 56 and be substantially perpendicular to the principal axis of the coupling pin which is vertical in FIG. 2. A distal portion 60 of the lever arm 42 may engage the actuation arms 58 and may be retained by slot 62 formed in arm guide member 64. The channel means 54 and the guide member 64 may be integral. The slot 62 may be provided with a detent by forming a notch 66 in the guide member to receive the distal portion of the lever arm.

Figure 3:
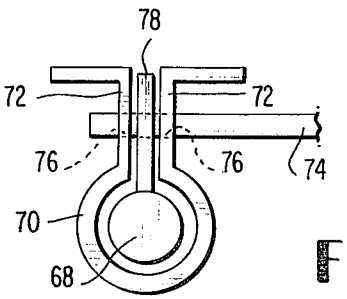
FIG. 3 is a top view in partial phantom of a portion of the embodiment of the present invention depicted in FIG. 2.

With reference to FIG. 3, a top view of a portion of an embodiment of the present invention depicted in FIG. 2 is shown. Coupling pin 68 may be encircled by channel means 70. The channel means 70 may be integral with guide member 72. A lever arm 74 may be inserted through slots 76 in the guide member and through actuation arm 78.

Referring once again to FIG. 2 to consider the operation of the apparatus, an operator may grasp the proximal portion 43 of lever arm 42 to insert and withdraw coupling pin 56 to couple and uncouple hitch 54 and the hitch of an adjacent car. The proximal portion 43 of the lever arm may extend beyond the plane of a lateral side of the mine car to which it is attached to permit the operator to couple and uncouple cars without standing between the cars. Coupling pin 56 may be maintained in an inserted position effecting coupling of the cars by raising the proximal portion 43 of the lever arm so that spring means 50 urges the distal portion 60 of the arm into notch 66 of the guide member 64.

Figures 4, 5:
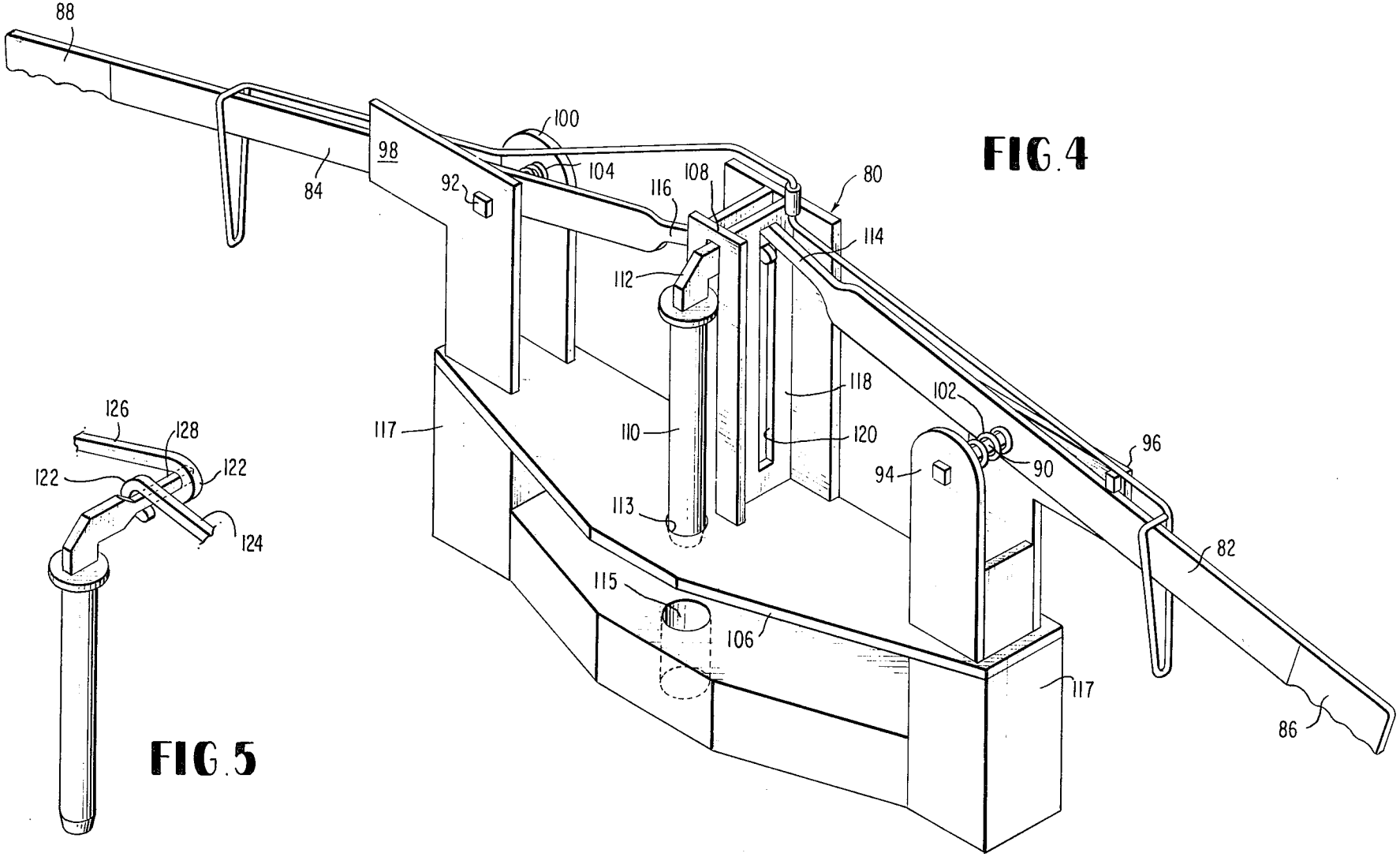
FIG. 4 is a perspective view of a second embodiment of the coupling apparatus of the present invention.
FIG. 5 is a perspective view of a portion of the second embodiment of the present invention depicted in FIG. 4.

Referring now to FIG. 4, a second embodiment of the present invention is denoted generally by the numeral 80. Lever arms 82 and 84 may be of sufficient length so that their proximal portions 86 and 88 extend near or beyond the lateral sides of the mine car to which the apparatus 80 is attached. The lever arms 82 and 84 may be pivotably supported by shafts 90 and 92 which are attached to parallel members 94 and 96, and 98 and 100, respectively. A first coil spring means 102, concentric with the shaft 90, may contact the parallel member 94 and may urge the lever arm 82 rearward toward parallel member 96. A second coil spring means 104, concentric with the shaft 92, may contact the parallel member 100 and may urge the lever arm 84 frontward toward parallel member 98.

The parallel members may be attached to horizontal base plate 106. The base plate is adapted to be affixed to a conventional mine car hitch 107. A channel means 108, attached to the base plate 106, may guide the insertion and withdrawal of coupling pin 110 into and out of the mine car hitches by defining a path of vertical movement for actuator arm 112 itself attached to the coupling pin. The apparatus of the present invention may be installed on a conventional mine car by aligning the coupling pin 110 and base plate aperture 113 with hitch aperture 115 and by welding, bolting or otherwise affixing the base plate 106 to existing vertical hitch members 117.

Distal portions 114 and 116 of the lever arms 82 and 84 may be formed in loops to engage the actuator arm 112. With reference to FIG. 5, wherein the guide member and channel means have been cut away, the engagement of loops 122 in distal portions 124 and 126 of the lever arms with actuator arm 128 is shown. With continued reference to FIG. 4, the distal portions 114 and 116 of the lever arms may be retained by slots in arm guide member 118. The perimeter of one such slot 120 engages the distal portion 114 of the lever arm 82. A second slot on the opposite side of the arm guide member 118 for engaging the distal portion 116 of lever arm 84 is not visible in the Figure.

To affect coupling or uncoupling, an operator may grasp either proximal portion 86 or 88 of the lever arms to apply a force to insert or withdraw coupling pin 110. Because the proximal portions 86 and 88 of the lever arms extend near or beyond the planes of the lateral sides of the mine car to which they are attached, the operator may safely couple and uncouple the cars without standing between the cars. Coupling pin 110 may be maintained in the desired position to effect coupling or uncoupling by raising or lowering the proximal portions 86 and 88 of the lever arms. The coil spring means 102 and 104 may be operative to cause engagement between distal portions 114 and 116 of the lever arms and the perimeters of the slots in guide member 118 thereby offering resistance to upward or downward motion of the coupling pin except in response to a force applied to either or both proximal portions of the lever arms. The spring means may also be operative to cause the loops in the distal portions of the lever arms to space themselves apart along the actuation arm to assure near vertical insertion and withdrawal of the coupling pin.

The principles, preferred embodiments, and modes of operation of the present invention have been described in the foregoing specification. The invention which is intended to be protected is not, however, to be construed as limited to the particular forms disclosed, since these are to be regarded as illustrative rather than restrictive. Variations and changes may be made by those skilled in the art without departing from the spirit and scope of the present invention.

What is claimed is:

1. An apparatus for safely coupling and uncoupling mine cars which are coupled by insertion of a pin into coupling hitches of two adjacent cars comprising:

an apertured base plate adapted to be horizontally affixed to a hitch of a mine car;

a lever arm, a distal portion of which engages the coupling pin, adapted for inserting and withdrawing the pin to couple and uncouple a railroad car responsive to application of force to a proximal portion of said lever arm to permit an operator to couple and uncouple the cars without standing between the cars;

means attached to said base plate for pivotably supporting said lever arm on said base plate;

means for guiding the travel of said lever arm and the travel of the coupling pin through the aperture in the base plate and the hitches comprising:

a guide member attached to said base plate and formed with a slot for retaining the distal portion of said lever arm and defining a path of travel of said lever arm, said slot being knotched to provide a detent for the distal portion of said lever arm; and, a channel means for guiding the coupling pin through its range of movement incident to insertion and withdrawal; and spring means for urging said lever arm into engagement with a portion of the perimeter of the slot of said guide member and for urging the lever arm into the detent, thereby tending to retain said lever arm in a fixed position along the path of travel of said lever arm.

2. The apparatus of claim 1 wherein said support means comprises:

two substantially parallel, vertical members attached to said base plate; and, a shaft, attached to both of said parallel members, on which shaft said lever arm is pivotably mounted.

3. The apparatus of claim 2 wherein said spring means is a coil spring coaxially positioned about said shaft, with a first end engaging one of said parallel members and a second end engaging said lever arm and urging said lever arm toward the other of said parallel members.

4. The apparatus of claim 3 wherein the distal portion of said lever arm engages the coupling pin by being disposed in an aperture in the coupling pin.

5. The apparatus of claim 3 wherein the distal portion of said lever arm is formed in a loop which pivotably engages the coupling pin.

6. An apparatus for safely coupling and uncoupling mine cars provided with apertured coupling hitches comprising:

a coupling pin adapted for insertion into the apertures of coupling hitches of adjacent mine cars to couple the cars;

an actuation arm attached to said coupling pin and substantially perpendicular to the principal axis of said coupling pin;

a lever arm, a distal portion of which engages said actuation arm, adapted for inserting and withdrawing the coupling pin to couple and uncouple the railroad cars responsive to application of force to a proximal portion of said lever arm to permit and operator to couple and uncouple the cars without standing between the cars;

a base plate adapted to be horizontally affixed to a hitch of a mine car to be coupled;

means for pivotably supporting said lever arm on said base plate;

means for guiding the travel of said lever arm and said coupling pin, attached to said base plate, formed with a first slot through which said actuation arm is disposed for guiding the insertion of said coupling pin into the apertures of the coupling hitches of the mine cars, and formed with a second slot through which the distal portion of said lever arm is disposed for guiding said lever arm along a path of travel operative to cause insertion and withdrawal of said coupling pin, wherein the slot of said guide member is notched to provide a detent for the distal portion of said lever arm; and, spring means for urging said lever arm into the detent to maintain said lever arm and said coupling-pin in a manually selectable position.

* * * * *